US005078197A

United States Patent [19]

Weishar

[11] Patent Number: 5,078,197

[45] Date of Patent: Jan. 7, 1992

[54] MANUALLY OPERATED INDUSTRIAL ROLL DOOR

[75] Inventor: William B. Weishar, Brookfield, Wis.

[73] Assignee: Kelley Company Inc., Milwaukee, Wis.

[21] Appl. No.: 505,226

[22] Filed: Apr. 5, 1990

[51] Int. Cl.[5] ..... A47G 5/00

[52] U.S. Cl. ..... 160/265; 160/133

[58] Field of Search ..... 160/265, 133, 190, 271, 160/290.1

[56] References Cited

U.S. PATENT DOCUMENTS

| | | | |
|---|---|---|---|
| 1,912,829 | 6/1933 | Crume | 160/190 |
| 1,994,142 | 3/1935 | Madsen | 160/190 |
| 3,460,602 | 8/1969 | Hugus . | |
| 3,878,879 | 1/1975 | Mann | 160/273 |
| 3,981,343 | 9/1976 | DeVito | 160/9 |
| 4,178,978 | 12/1979 | Burnham | 160/133 X |
| 4,237,956 | 12/1980 | Sivin et al. | 160/133 X |
| 4,770,224 | 9/1988 | Dubbelman | 160/331 |

FOREIGN PATENT DOCUMENTS 2556403 6/1985 France .

*Primary Examiner*—Reinaldo P. Machado
*Assistant Examiner*—Sarah A. Lechok
*Attorney, Agent, or Firm*—Andrus, Sceales, Starke & Sawall

[57] ABSTRACT

A manually operated roll door. The door comprises a flexible door panel that is coiled on a drum located above the header of a doorway in a building, and the door panel is manually movable between an open position where the door panel is coiled on the drum, to a closed position where it encloses the doorway. A latch mechanism is associated with the door panel and automatically latches the door panel in the closed position. A handle is attached to the lower end of the door panel and the handle is connected to the latch mechanism in a manner such that an upward pull on the handle to open the door panel will simultaneously release the latch mechanism. A counterbalancing weight is operably connected to the door panel and partially counterbalances the weight of the door panel to aid in manually moving the door panel to the open position.

16 Claims, 2 Drawing Sheets

MANUALLY OPERATED INDUSTRIAL ROLL DOOR

BACKGROUND OF THE INVENTION

Industrial doors are used in industrial or commercial buildings to separate zones of different temperature or humidity conditions or prevent noise propagation between the zones. One common form of industrial door is a roll door in which a fabric door panel is coiled on a drum located above the header of the doorway. As the door panel of a roll door is composed of fabric material, it provides an attractive appearance, and due to the flexible nature of the door panel, it is less susceptible to denting or other damage as compared to a rigid door.

The typical roll door is power operated and incorporates a drive mechanism that is connected to the drum and operation of the drive mechanism in one direction will uncoil the door panel to move the panel to a closed position, while operation of the drive mechanism in the opposite direction will act to wind the panel on the drum and move the door panel to the open position.

In addition, the drive mechanism also includes a clutch which can be manually operated to disconnect the drive. A clutch is required in order to provide manual operation of the door in case of fire or a power outage or during maintenance or installation of the door. The drive mechanism adds considerably to the overall cost of the roll door.

Industrial roll doors are commonly used with loading docks. In installations where there are multiple loading docks, the docks are relatively close together with perhaps only about 18 inches between adjacent docks. Because of the close proximity, a conventional power operated roll door cannot be utilized in these installations.

Therefore, there has been a need for an inexpensive, compact, manually-operated, industrial roll door.

SUMMARY OF THE INVENTION

The invention is directed to a manually operable roll door for use with a commercial or industrial establishment. The door includes a flexible door panel composed of fabric which is adapted to be rolled on a drum located above the header of the doorway. The panel can be moved manually from an open position where it is coiled on the drum, to a closed position where it encloses the doorway.

The lower end of the door panel is connected to a rigid beam, and latch elements associated with the ends of the beam are automatically engaged with latch elements on the door frame when the door panel is moved to the closed position to thereby hold or latch the panel in the closed position. Attached to the beam is a handle, and the handle is operably connected to the latch elements on the ends of the beam in a manner such that an upward pull on the handle to open the door panel will simultaneously release the latching mechanism to enable the door panel to be moved upwardly to the open position.

To aid in counterbalancing the weight of the door panel, a counterweight is operably connected to the drum through a generally flat belt or strap. The counterweight aids in lifting the door panel to the open position, and also aids in maintaining the door panel in a stretched or taut condition when the door panel is closed to minimize wind deflection.

The door construction of the invention is of simple and inexpensive construction with no power source required to operate the door.

As a further advantage, less side clearance is needed for the door with the result that the door has particular application for multiple loading docks where there is limited side clearance between the docks.

The door panel of the invention is automatically latched in the closed position for security and to minimize wind deflection, and the latch mechanism is automatically released on upward pull of the handle to raise the door panel.

The door panel is partially counterbalanced by a counterweight and a stop is employed to limit upward movement of the counterweight when the door panel is in the lower or closed position to thereby prevent unwinding of the door panel by wind action.

Other objects and advantages will appear during the course of the following description.

DESCRIPTION OF THE DRAWINGS

The drawings illustrate the best mode contemplated of carrying out the invention.

In the drawings.

DESCRIPTION OF THE ILLUSTRATED EMBODIMENT

Figure 1:
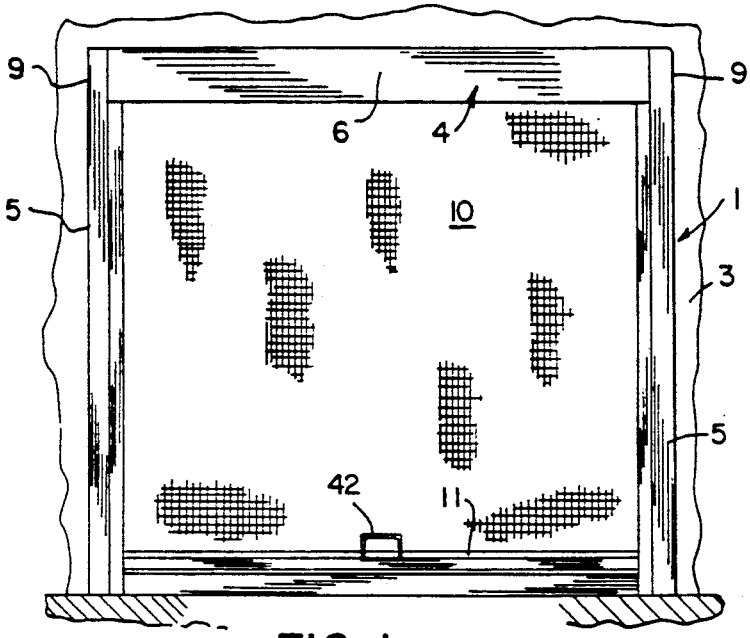
FIG. 1 is a front elevational view of the roll door of the invention.

The drawings illustrate an industrial, manually-operated roll door 1 which is adapted to enclosed a doorway 2 in a building 3. Door 1 can be used to separate two interior zones of the building or alternately can be employed to separate the interior of the building with the exterior.

Door 1 includes a frame 4 composed of a pair of side frame sections 5 which are located on opposite sides of doorway 2 and a header section 6 which is located above doorway 2.

Figure 5:
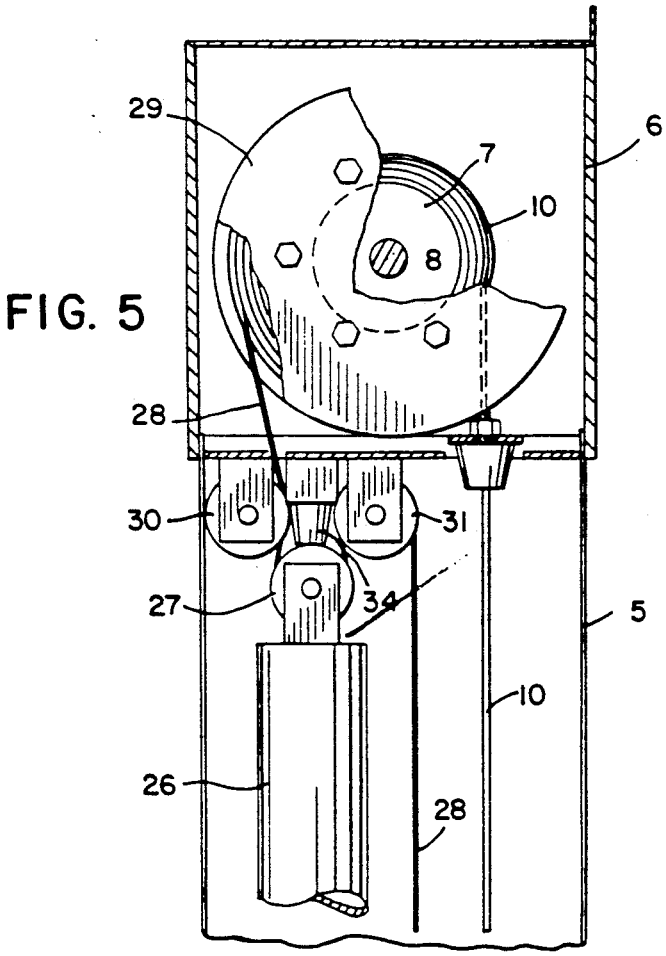
FIG. 5 is an enlarged fragmentary vertical section of the upper end of the door.
Figure 2:
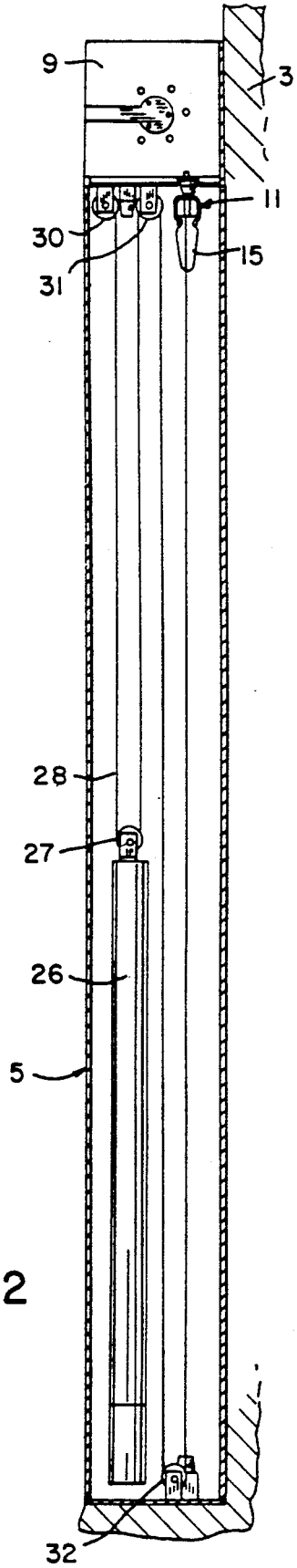
FIG. 2 is a vertical section showing the connection of the counterweight to the door panel.

A drum 7 is mounted for rotation within header section 6 and as shown in FIG. 5, each end of drum 7 carries a stub shaft 8 which is journalled within the end wall 9 of the respective side frame section 5.

A flexible door panel 10, preferably formed of fabric coated with a plastic material, is adapted to be wound on drum 7. Door panel 10 can be moved between an open position where it is wound on drum 7 to a closed or unwound position where the door panel encloses doorway 2 as shown in FIG. 1.

Figure 7:
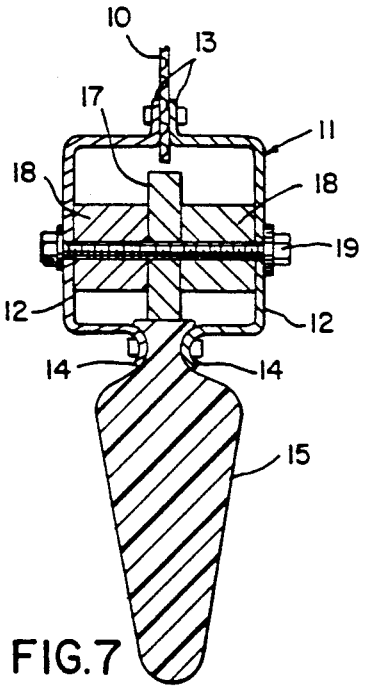
FIG. 7 is a section taken along line 7—7 of FIG. 3.

Connected to the lower end of door panel 10 is a rigid hollow beam 11, preferably formed of extruded aluminum. Beam 11 includes a pair of side sections 12 and the upper edge of each side section 12 is provided with a flange 13. The lower edge of door panel 10 is secured between the mating flanges 13 by suitable screws, as seen in FIG. 7.

Each side section 12 of beam 11 is also provided with a lower flange 14 and a bumper 15 formed of a resilient material, such as rubber, is attached between the lower flanges 14. Bumper 15 is of a conventional sponge rubber construction.

Figure 6:
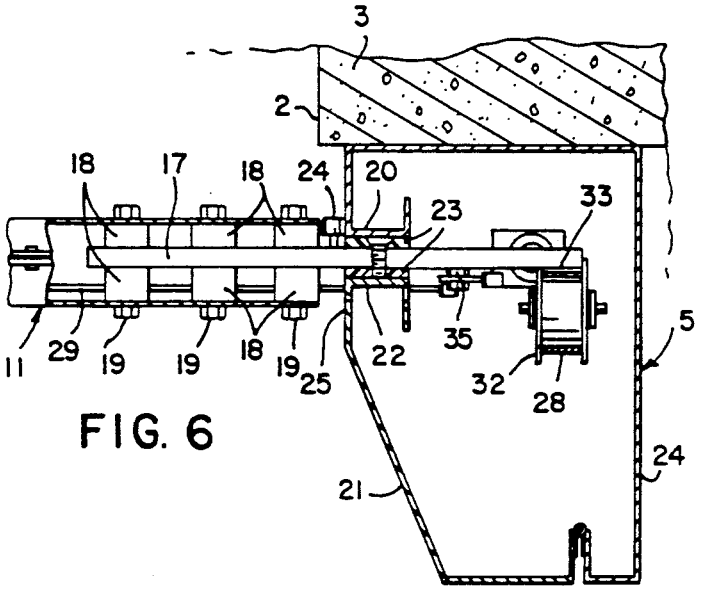
FIG. 6 is a section taken along line 6—6 of FIG. 3.

A plate 17 is mounted within each open end of beam 11 and projects beyond the end of the beam. As shown in FIGS. 6 and 7, the inner end of each plate 17 is attached through blocks 18 to the side sections 12 by bolts 19. With this construction, each plate 17 is located along the center line of the beam 11.

To guide door panel 10 in vertical movement, each side frame section 5 is provided with an inwardly extending flange 20, and similarly the cover 21 which is mounted for pivotal movement relative to wall 24 of frame section 5 is provided with a parallel flange 22 and the projecting ends of the plate 17 extend between the mating flanges 20 and 22, as illustrated in FIG. 6. Suitable low friction wear strips 23 formed of polyethylene, or the like, are attached to the plate 17 by screws to facilitate sliding movement of the plate 17 between the flanges 20 and 22. In addition, a roller or follower 24 is mounted on the central portion of each plate 17 and rides against the inner surface 25 of frame section 5.

Figure 3:
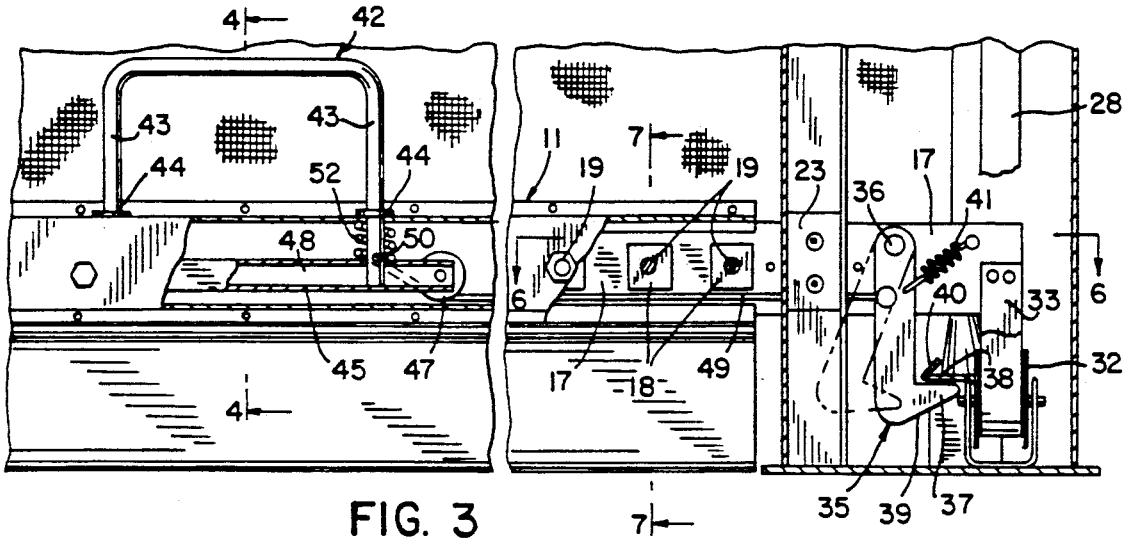
FIG. 3 is an enlarged, fragmentary elevational view with parts broken away showing the latching mechanism at the bottom of the door.

A counterbalancing mechanism is incorporated with the door panel 10, and as illustrated, takes the form of a pair of elongated weights 26, each of which is mounted within the respective side frame sections 5. A pulley 27 is mounted on the upper end of each weight 26 and a belt or strap 28, having a substantial greater width than thickness, is trained over pulley 27 and connects the beam 11 with a spool 29 which is mounted on each end of drum 7. As seen in FIG. 5, one end of each belt 28 is connected to the respective spool 29 and the belt then rides against pulley 30, downwardly around pulley 27, upwardly over pulley 31, and then down to the bottom of the frame section where it passes upwardly around pulley 32 and is clamped via a strap 33 to the end of the respective plate 17, as shown in FIG. 3.

The counterweight 26 aids in counterbalancing the weight of the door panel, and the weight and pulleys are arranged such that the downward force of the weight when the door panel is in the open or raised position, will act through a moment which will maintain the door in the open position. As the door panel is lowered, and the belt 28 is wound onto the spool, the moment will increase. The system is designed so that when the door panel is in the closed position, the weight of the door panel will be over counterbalanced to require less opening effort.

A resilient bumper 34 is mounted in the upper end of each frame section 5, and is positioned to be engaged by the respective pulley 27 as the counterweight moves upwardly within the frame section 5. The bumpers 34 limit the upward movement of the counterweight, and thus prevent the door panel from unwinding from the drum when the door panel is in the closed position and is subjected to wind pressure.

As a feature of the invention, a latch mechanism is incorporated with the door panel 10 which will automatically latch the door int eh down or closed position. In this regard, a latch 35 is pivotally connected to each end of plate 17 by a pivot 36. Each latch 35 is provided with a hook like end 37 which is adapted to engage a latch plate 38 secured to the lower end of each frame section 5.

Latch 35 is provided with an inclined surface 39 which is adapted to ride against cam surface 40 of plate 38 as the door panel is moved to the closed position, and engagement of surface 39 with cam 40 will wedge the latch outwardly, and after the hook end 37 is lowered beneath the latch plate, a spring 41 which is interconnected between latch 35 and plate 17 will bias the latch to a latched position relative to plate 38, thus preventing upward movement of the door panel.

Figure 4:
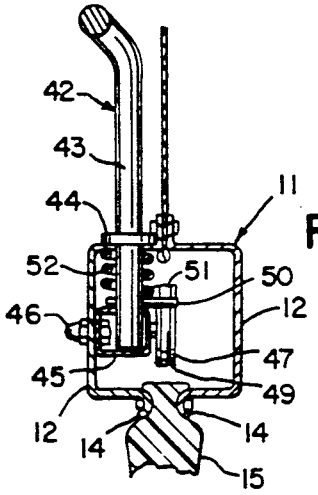
FIG. 4 is a section taken along line 4—4 of FIG. 3.

The latch mechanism is adapted to be automatically released as the door panel is manually moved upwardly. An inverted generally U-shaped handle 42 is secured to the central portion of beam 11. As best shown in FIGS. 3 and 4, handle 42 is provided with a pair of generally parallel arms 43, and a ring 44 is secured to each arm and bears against the upper surface of side section 12 of beam 11 as shown in FIG. 4.

The lower end of each arm 43 of handle 42 extends through an opening in a bracket 45 which is connected by bolts 46 to side section 12, as seen in FIG. 4. A pair of pulleys 47 are mounted for rotation on the upwardly extending flange 48 of bracket 45, and pulleys 47 are located generally along the center line of beam 11 as illustrated in FIG. 4.

One end of a flexible member, such as a cable 49 is attached to each latch 35 as shown in FIG. 3, and each cable is trained over the respective pulley 47. The opposite end of each cable is connected to a pin 50 which extends through the respective arm 43 of the handle and is located above the upper flange of U-bracket 45. The connection of cable 49 to pin 50 can be made by extending the cable through an eye in the pin and providing the end of the cable with a stop or connector 51. Coil spring 52 is interposed between the upper surface of side section 12 and pin 50, and serves to urge the handle 42 to a lower position.

When it is desired to move the door panel to the open position, an operator pulls upwardly on handle 42, and upward movement of the handle will act through the cables 49 to simultaneously pivot the latches 35 to the released position. With the latches released, the door panel can be moved upwardly to the open position. On release of the handle, latches 35 will automatically be returned to their original position by the springs 41.

The door construction of the invention is of simple and inexpensive construction with no power being required to move the door between the open and closed position.

As a further advantage, the door requires less side clearance than power operated roll doors and thus has particular application for use in facilities having multiple side-by-side loading docks.

The door handle is automatically locked or latched in the closed position for security and to prevent movement of the door under wind pressure. Further, the latch is automatically released as the operator pulls upwardly on the handle to move the door to the open position.

Various modes of carrying out the invention are contemplated as being within the scope of the following claims particularly pointing out and distinctly claiming the subject matter which is regarded as the invention.

I claim:

1. A manually operated roll door construction to enclose a doorway in a structure, comprising a frame to be mounted to the structure, a drum mounted for rotation on the frame and disposed above the doorway, a flexible door panel disposed in coiled form on said drum, said door panel being movable between an unwound closed position where said door panel encloses sad doorway to an open position where said door panel is wound on said drum, latch means for latching the door panel in said closed position and movable between a latching position and a release position, handle means operably connected to the lower portion of the door panel and disposed to be engaged by an operator to move the door panel from the closed position to the open position, said handle means being movable between a first position and a second position, and means responsive to an upward pull on said handle means for releasing said latch means and comprising a flexible operating element interconnecting said handle means and said latch means, said flexible operating element being constructed and arranged to move said latch means to the released position when said upward pull is applied to said handle means.

2. The door of claim 1, and including means for preventing unwinding of the door panel from said drum when the door panel is in the closed position.

3. The door of claim 1, and including counterbalancing means operably connected to said drum for counterbalancing the weight of the door panel.

4. The door of claim 3, wherein said counterbalancing means comprises a weight, and a flexible member innerconnecting said weight and said drum.

5. The door of claim 1, wherein said flexible element comprises a cable.

6. The door of claim 1, wherein said latch means is mounted for pivotal movement between said latching position and said release position.

7. The door of claim 1, wherein said latch means comprises a first latch element mounted on the lower portion of said door panel and a second latch element mounted on said frame.

8. A manually operated roll door to enclose a doorway in a structure, comprising a frame mounted on said structure, a drum mounted for rotation on the frame and located above the doorway, a flexible door panel disposed in coiled form on said drum, said door panel being movable between an unwound closed position where said door panel encloses said doorway to an open position where said door panel is wound on said drum, latch means for latching the door panel in the closed position and movable between a latching position and a release position, counterbalancing means operably connected to said drum for counterbalancing the weight of the door panel, said counterbalancing means comprising a counterweight, a spool connected to said drum, and a flexible member to support the counterweight, one end of said flexible member connected to said spool and the opposite end of said flexible member being attached to the lower end of said door panel, handle means operably connected to the lower portion of said door panel and disposed to be engaged by an operator to move the door panel between the closed position and the open position, and means responsive to movement of the door panel to the closed position for moving said latch means to the latching position.

9. The door of claim 8, and including a rigid beam connected to the lower end of the door panel, said flexible member being attached to said beam.

10. The door of claim 9, wherein said flexible member comprises a strap having a substantially greater width than thickness.

11. The door of claim 9, wherein said handle means is connected to said beam.

12. The door of claim 8, and including stop means at the upper end of said frame and disposed to be engaged by said counterweight when said door panel is in the closed position to prevent unwinding of said door panel under wind pressure.

13. The door of claim 8, and including a rigid generally horizontal beam connected to the lower edge of said door panel, a first guide member connected each end of the beam and projecting beyond the respective end of the beam, guide means on said frame for guiding the projecting ends of the first guide members in movement as the door panel is moved between the open and closed positions, said latch means being disposed within said frame and mounted on the projecting end of at least one of said first guide members.

14. The door of claim 13, and including a second guide member mounted on the projecting end of each first guide member and disposed to ride against a surface of the respective frame as the door panel is moved between the open and closed positions.

15. A manually operated roll door to enclose a doorway in a building, comprising a frame attached to said building, a drum mounted for rotation on said frame and located above the doorway, a flexible door panel disposed in coiled form on said drum, said door panel being movable between an unwound closed position where said door panel encloses said doorway to an open position where said door panel is wound on said drum, a rigid beam attached to the lower end of said door panel, latch means for latching the door panel in a closed position, said latch means including a fixed latch element and a movable latch element, one of said latch elements being connected to an end of said beam and the other of said latch elements being connected to the lower end of said frame, said movable latch element being movable between a latching position and a release position, biasing means for biasing said movable latch element to the latching position, cam means disposed to be engaged by said movable latch element as said door panel moves to the closed position for moving said movable latch element to the release position, handle means connected to the beam for manually moving said door panel between the open and closed positions, and release means operably connected to said movable latch element for moving said movable latch element to the release position to enable the door to be moved from the closed to the open position.

16. A manually operated roll door construction to enclose a doorway in a structure, comprising a frame to be mounted on the structure, a drum mounted for rotation on the frame and disposed above the doorway, a flexible door panel disposed in coiled form on said drum, said door panel being movable between an unwound closed position where said door panel encloses said doorway to an open position where said door panel is wound on said drum, latch means for latching the door panel in the closed position, handle means operably connected to the door panel and disposed to be engaged by an operator to move the door panel between the closed position and open position, counterbalancing means operably connected to said drum for counterbalancing the weight of the door panel, and means for preventing unwinding of said door panel from said drum when said door panel is in the closed position and is subjected to an external force transverse to the plane of the closed door panel.

* * * * *